US008550606B2

(12) United States Patent
Ikebe et al.

(10) Patent No.: US 8,550,606 B2
(45) Date of Patent: Oct. 8, 2013

(54) LIQUID EJECTING APPARATUS

(75) Inventors: Norihiro Ikebe, Kawasaki (JP); Kenta Udagawa, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/216,492

(22) Filed: Aug. 24, 2011

(65) Prior Publication Data

US 2012/0050419 A1 Mar. 1, 2012

(30) Foreign Application Priority Data

Aug. 30, 2010 (JP) ..... 2010-192351
Aug. 22, 2011 (JP) ..... 2011-180741

(51) Int. Cl.
*B41J 2/175* (2006.01)
*B41J 2/17* (2006.01)

(52) U.S. Cl.
USPC ..... 347/85; 347/84; 347/86

(58) Field of Classification Search
USPC ..... 347/84, 85, 86
See application file for complete search history.

(56) References Cited

U.S. PATENT DOCUMENTS 7,566,120 B2 * 7/2009 Ishizawa et al. ..... 347/85
2007/0273734 A1 * 11/2007 Nakata et al. ..... 347/86
2011/0242231 A1 * 10/2011 Murray ..... 347/86

FOREIGN PATENT DOCUMENTS

JP 2002-307712 A 10/2002
JP 2006-255965 A 9/2006

* cited by examiner

*Primary Examiner* — Jannelle M LeBron
(74) *Attorney, Agent, or Firm* — Fitzpatrick, Cella, Harper & Scinto

(57) ABSTRACT

In a liquid ejecting apparatus, sub-ink-tanks and a connection end of a sub-ink-tank accommodation unit are connected through a fixation portion and a connection pin. The sub-ink-tanks are fixed to a tank accommodation portion by way of small screws being respectively screwed, through through-holes and of the sub-ink-tanks, into threaded apertures.

15 Claims, 10 Drawing Sheets

LIQUID EJECTING APPARATUS

BACKGROUND OF THE INVENTION

1. Field of the Invention

The invention relates to a liquid ejecting apparatus that is provided with a tank accommodation unit for accommodating sub-ink-tanks that are connected to a main ink tank through ink tubes.

2. Description of the Related Art

There are cases where ink jet printers must deal with the printing of relatively large amounts of ink. For example, as shown in Japanese Patent Laid-Open No. 2002-307712, there are cases where sub-ink-tanks are provided on a print head unit that has an ink ejection portion that ejects ink, and main ink tanks, which supply ink to the sub-ink-tanks, are provided separately on the main body of the printer. The sub-ink-tanks of the print head unit and the main ink tanks are connected by ink supply tubes that form ink supply pathways. Herewith, each of the inks from ink retention units of each of the main ink tanks is separately supplied to the sub-ink-tanks through the set of ink supply tubes.

And, for example, a serial ink jet printer carries out the printing of ink by way of the print head unit ejecting ink on the printing surface of a print medium while a carriage, in which the aforementioned print head unit is detachably mounted, moves back and forthwith respect to the print surface of the print medium. As for such serial printers, when performing the supply of ink to the print head unit, there are cases where a change of the ink pressure inside the print head unit occurs, due to acceleration and deceleration that comes along with back and forth movement of the carriage. In a case where an ink pressure variation has occurred, there is a danger that the ejection of ink at the ink ejection portion of the print head unit will become unstable. In particular, in the case where the carriage reciprocates at a high speed for the purpose of high speed printing, the influence of ink pressure variation, caused by acceleration and deceleration, becomes larger.

As a solution to this problem, as described in Japanese Patent Laid-Open No. 2002-307712, it is proposed to mount sub-ink-tanks in the print head unit, which sub-ink-tanks have pressure regulation parts that regulate ink pressure.

By way of providing a negative pressure generation mechanism as a pressure regulation part at the portion of the ink ejection unit of the print head unit that is on the upstream side, the ink ejection portion can eject ink without being effected by pressure variation of ink inside the print head unit, caused by the back and forth movement of the print head. Therefore, in printers of this type space is necessary for sub-ink-tanks to be disposed inside the print head unit.

In printers such as that mentioned above, a needle of a needle holding member provided at one end of an ink supply tube (see Japanese Patent Laid-Open No. 2002-307712) is capable of being inserted and removed, through a sealing member, into and out of a needle acceptance portion of the print head unit, which needle acceptance portion is in communication with the sub-ink-tank. In the case where a replacement is necessary, for example, a case where a failure has occurred in the print head unit, or a case where the duration of use of the print head unit has reached its lifespan, in order to replace the print head unit, the needle of the needle holding member is removed from the needle acceptance portion of the print head unit. On the other hand, in the case of carrying out the connection of needles and the needle acceptance portion, through the sealing member, the full load, along the direction of insertion of the needle, which is caused by friction between the tips of each of the needles and each of the contacted surfaces of the sealing members, acts on the contour portion that forms the needle acceptance portion of the print head unit. In doing so, it is necessary that damage to the printer main body and the print head unit due to the insertion force of these needles, and problems such as ink leakage between the needles and the needle acceptance portions, do not occur.

Additionally, for example, as set forth in Japanese Patent Laid-Open No. 2006-255965, an apparatus is proposed wherein ink inside each of the main ink tanks is supplied to the print head unit through an ink supply tube group, via the pressurized air of a pressure pump.

SUMMARY OF THE INVENTION

In a case where the number of ink colors supplied to a print head unit such as the one described above is relatively small, the number of needles, and the number of sealing members at the needle acceptance portions of the sub-ink-tanks, are also small. Thus, at the time of the connection operation, the insertion force of the needles, which acts on the contour portion of the print head unit through the sealing member along the direction of insertion of the needle, is small.

However, with ink jet printers, there is a tendency for the number of ink colors supplied to the print head unit to increase as high image quality printing is demanded. In such cases the number of needles and sealing members also increases. As a result, in such cases a plurality of needle acceptance portions of the print head unit, and a plurality of needles, are connected through sealing members inside the needle acceptance portion. In this case, the resultant force of each of the needle insertion forces, which act along the direction of insertion on the portion of the contour portion of the print head unit at which the sealing member and the needle acceptance portion is provided (also referred to below as the connection end of the print head unit), increases in accordance with the growth of the number of ink colors.

And, in the case of dealing with high speed printing as mentioned above, there is a necessity to ensure space inside the print head unit for mounting sub-ink-tanks, because the sub-ink-tanks are disposed inside the print head unit. Thus, in this configuration, the number of sub-ink-tanks, which store each of the inks, increases as the number of ink colors increases. Because of this, the resultant force of each of the needle insertion forces that act on the connection end of the print head unit increases, and due to the resultant force of each of the insertion forces along the insertion direction of the needle, and insufficient strength of the connection end, there is a possibility that damage may occur, such as the connection end bending greatly, thus deforming and a crack forming therein.

As a measure to prevent the aforementioned deformation of the connection end, a method has been considered wherein the strength of the connection end is increased by way of increasing the material thickness of the connection end or providing a plurality of beams that are parallel to the needle insertion direction at the space inside the print head unit. However, increasing the material thickness of the connection end, as well as increasing the number of beams, as mentioned above, causes a problem wherein the size of the print head unit increases, and as such is an inexpedient solution.

In light of the above problems, the present invention aims to provide a liquid ejection apparatus. The liquid ejection apparatus can increase the rigidity of a tank reception portion in accordance with the number of sub-ink-tanks, without an increase in the size of the liquid ejection apparatus.

In order to accomplish the above described object, the liquid ejection apparatus of the invention comprises: a print head that ejects ink, a sub-ink-tank that has an ink retention portion that retains the ink, an ink supply needle that that has an ink supply aperture formed therein that supplies ink to the sub-ink-tank, a tank accommodation unit that is connected to the sub-ink-tank and forms an ink flow path that is in communication with the ink retention portion, when the-sub-ink-tank is accommodated therein, a sealing member that seals an aperture that is connected to the ink flow path provided on the tank accommodation unit, and a plurality of fixation portions, which are for fixing the sub-ink-tank and the tank accommodation unit, and which include at least one fixation portion that is provided above the aperture, wherein the tank accommodation unit, which is pushed toward the sub-ink-tank by the ink supply needle that is inserted through the sealing member into the aperture, is pushed back, in the direction that is opposite to the insertion direction of the ink supply needle, by the plurality of fixation portions, which are disposed on the sub-ink-tank along a straight line extending along the longer direction of the sub-ink-tank.

Further features of the present invention will become apparent from the following description of exemplary embodiments (with reference to the attached drawings).

DESCRIPTION OF THE EMBODIMENTS

Figure 2:
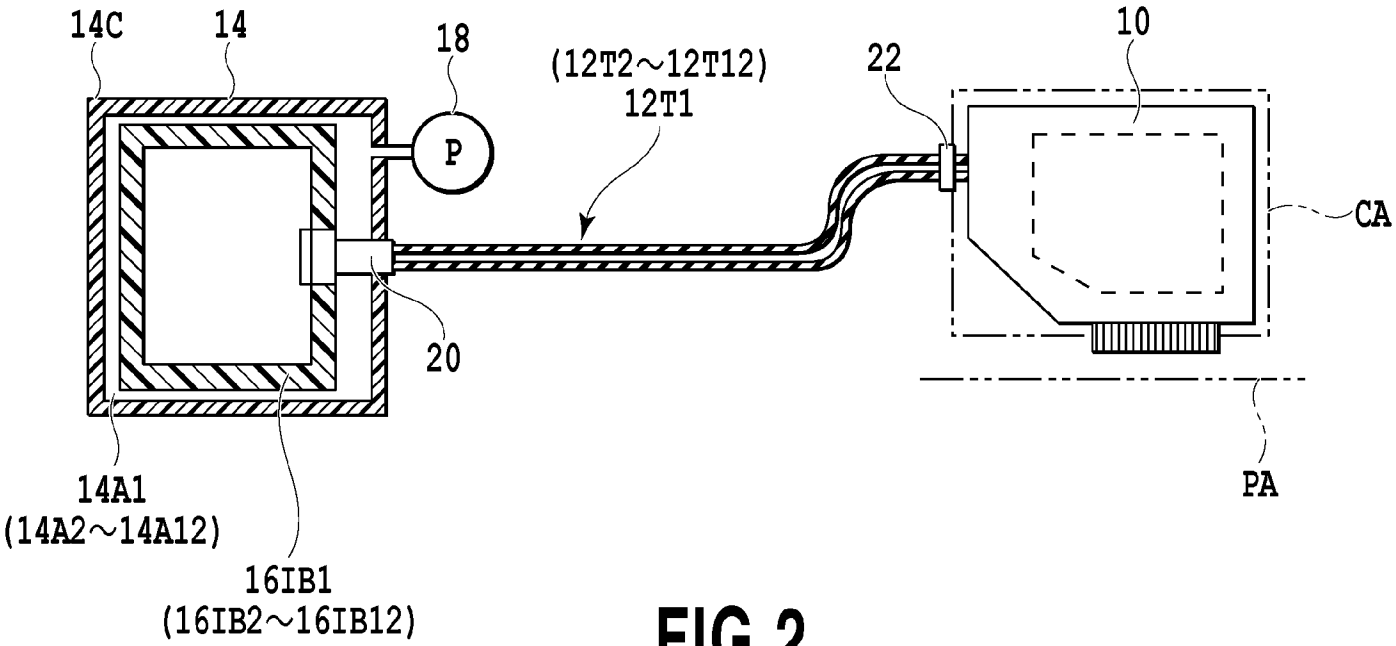
FIG. 2 is a configuration diagram that schematically illustrates a state where the liquid ejection apparatus illustrated in FIG. 1 is connected to a main ink tank.

FIG. 2 is a configuration diagram that schematically illustrates a state where an example of the liquid ejection apparatus according to the present invention is connected to a main ink tank.

In FIG. 2 ink bags 16IB1 to 16IB12, which are respectively housed inside main ink tank 14, are detachably connected to the print head unit 10 through respective ink supply tubes 12T1 to 12T12 and respective tube connecting connectors 22 (only one ink bag, one ink supply tube and one connector are typically illustrated in FIG. 2). Sub-ink-tanks, to be described later, are mounted in a sub-ink-tank accommodation unit of the print head unit 10. Two colors of ink are mounted as a unit in one sub-ink tank. The main ink tank, having 12 differing ink colors, is connected to pressure regulating units of each of the sub ink tanks 26ST1 to 26ST6.

Although not shown in the figure, the main ink tanks 14 are disposed inside of an ink jet printer, for example. The main ink tank 14 has twelve small chambers 14A1 to 14A12 within tank cases 14C, and the small chambers each have a structure that houses one ink bag. The main ink tank 14 has twelve ink bags which are mounted in the small chambers, respectively. All of the small chambers 14A1 to 14A12 inside the main ink tank 14 are in communication with each other through a communication pathway. A single pressure pump is connected to the communication pathway. Thus pressure inside the small chambers 14A1 to 14A12 is controlled by the common pump 18, through the communication pathway.

Operation of the pressure pump 18 is controlled by a control unit (omitted from the figure), based on the detected output from a pressure sensor provided in the ink supply tubes to be described later. The control unit, based on the detected output from the pressure sensor, supplies pressurized air, which is at a prescribed pressure, to the communication pathway via the pressure pump 18, such as to pressurize the ink bags 16IB1 to 161B12 inside the main ink tank with air. Herewith each of the inks inside the ink bags 16IB1 to 161B12, which are pressurized by the pressurized air, are supplied to the print head unit to be described later. That is, ink is stably supplied to the sub-ink-tanks also in the case of high speed printing, by way of each of the inks being supplied by pressure.

Prescribed amounts (for example, on the order of 40 cc) of grey ink, black ink, yellow ink, magenta ink, cyan ink, light ink of prescribed ink colors, and processing liquid, etc., are respectively housed inside the ink bags 16IB1 to 161B12.

A spout 20 is provided, as an ink supply port, on each of the ink bags 16IB1 to 161B12. With each of the ink bags 16IB1 to 161B12, the later described ink supply tubes 12T1 to 12T12 are detachably inserted into ends of the spouts, which are exposed to the peripheries of the each of the small chambers 14A1 to 14A12. When the end of an ink supply tube is connected to the spout 20, it is sealed with respect to the spout 20.

Figure 3:
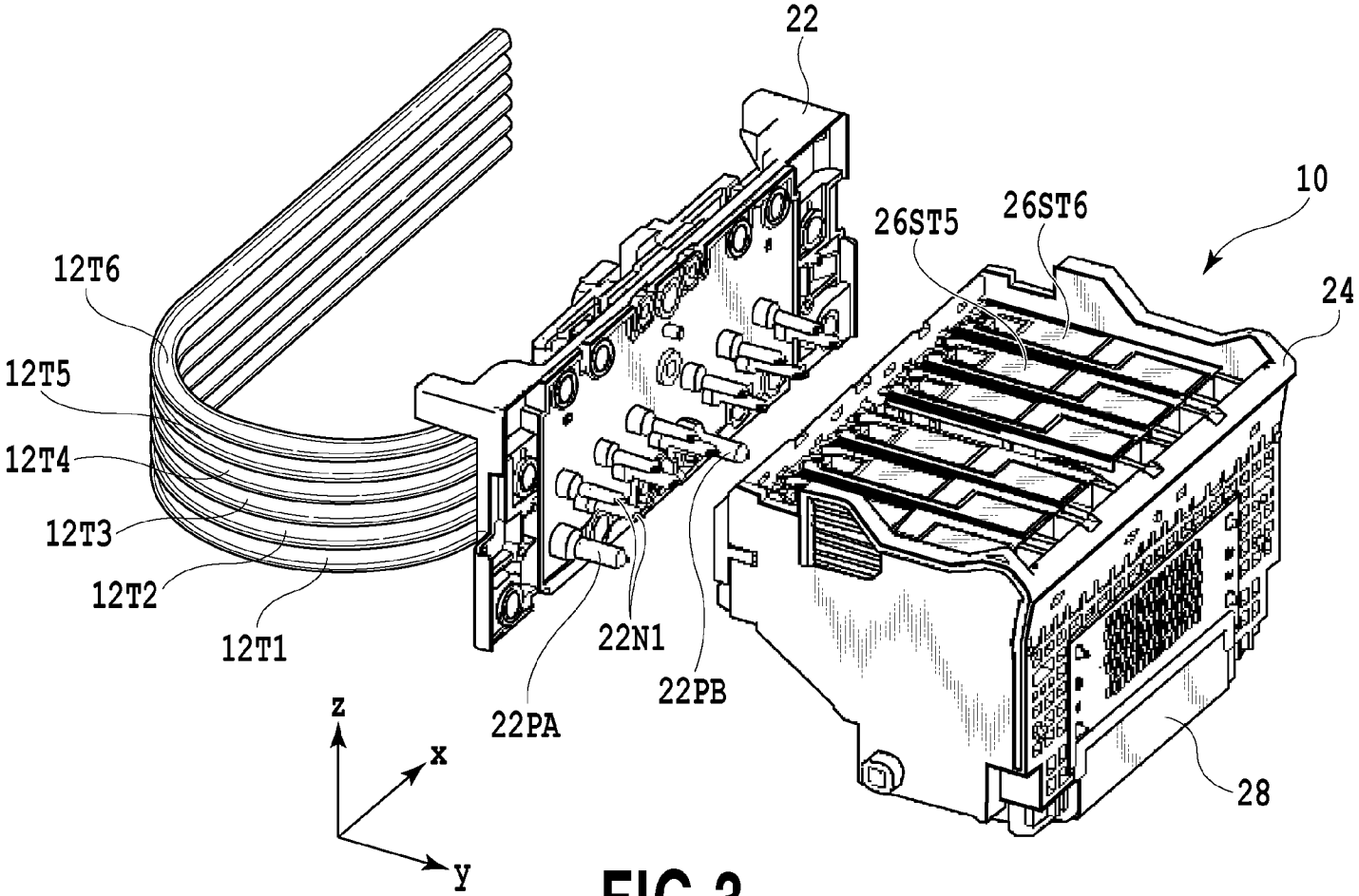
FIG. 3 is a perspective view that illustrates a tube connecting connector along with the liquid ejection apparatus illustrated in FIG. 1.
Figure 4:
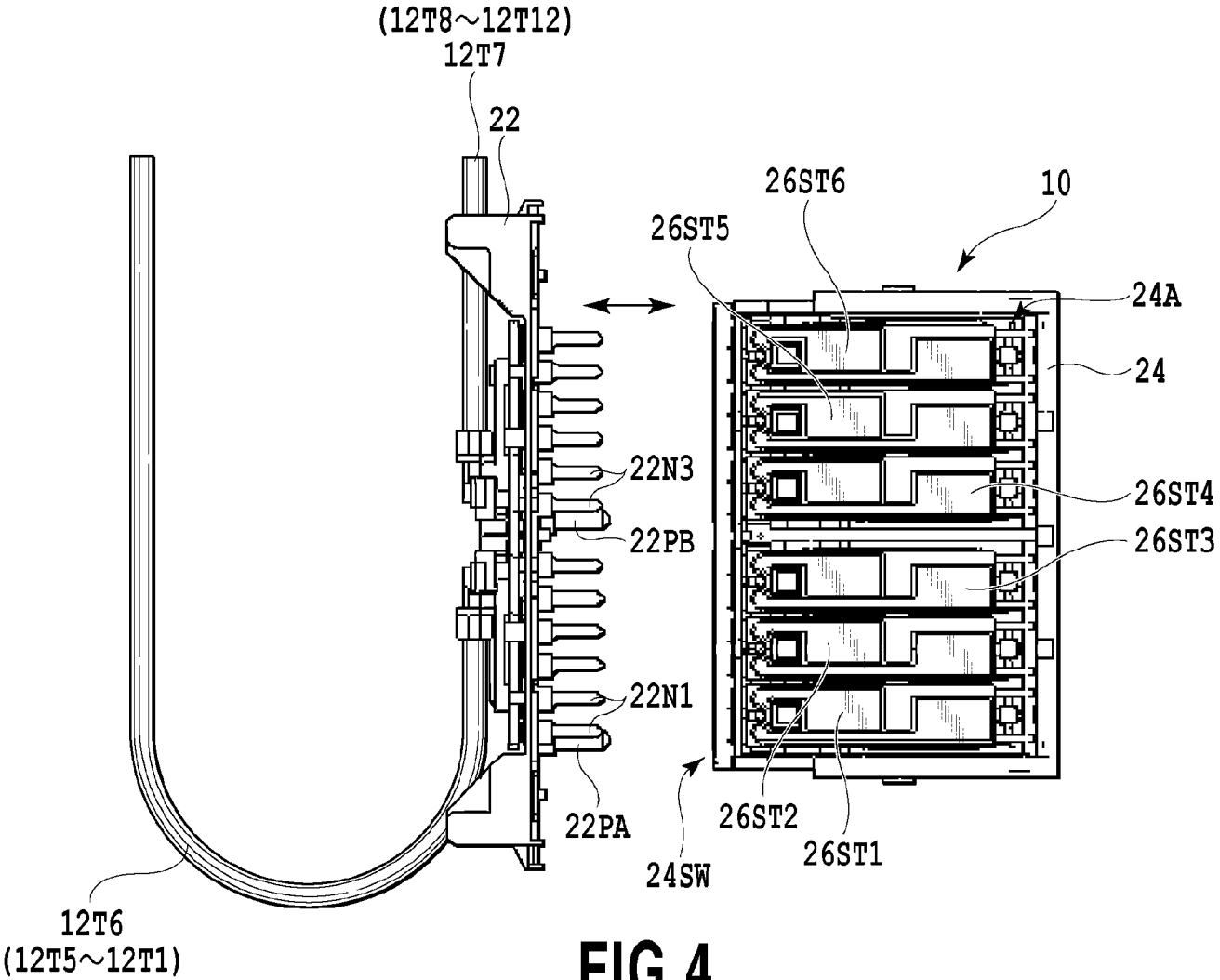
FIG. 4 is a plan view of the example shown in FIG. 3.

The other ends of the flexible ink supply tubes 12T1 to 12T12 are respectively connected to the tube connecting portion of the tube connecting connectors 22. As shown by FIGS. 3 and 4, the tube connecting connector 22 has two mutually facing surfaces, on one side of which the tube connection portion is formed. The tube connection portion has a plurality of ports that individually communicate with the internal pathways of each of the later described ink supply needles. The other ends of the ink supply tubes 12T1 to 12T6 are connected to each of the ports of one port group of the tube connection portion (the upper row port group), and the other ends of the ink supply tubes 12T7 to 12T12 are connected to each of the ports of the other port group of the tube connection portion (the lower row port group).

The ink supply needles 22N1 to 22N6, which communicate with the ports referred to above and are laid out with one pair for double file, are each formed such as to project from the other surface of the tube connecting connector 22 and to be inserted into apertures of the sub-ink-tanks.

The tube connecting connector 22 is detachable, along the direction shown by the arrows of FIG. 4, from the later described connection end 24SW of the sub-ink-tank accommodation unit 24 of the print head unit 10. It should be noted that the tube connecting connector 22 is held with respect to the print head unit 10 and a carriage CA by way of a locking/unlocking mechanism (not shown), which is mounted on the later described carriage.

In the case where the tube connecting connector 22 is connected to the later described connection end 24SW of the sub-ink-tank accommodation unit 24 of the print head unit 10, a pair of the ink supply needles 22N1, 22N2, 22N3, 22N4, 22N5, and 22N6 respectively come close to the connection end 24SW at approximately the same time. As shown in FIG. 3, a pair of the ink supply needles 22N1 to 22N6 of the tube connecting connector 22 approach the connection end 24SW along the direction denoted by the Y arrow, which is perpendicular to the alignment direction of the of the ink supply needles 22N1 to 22N6.

Figure 5:
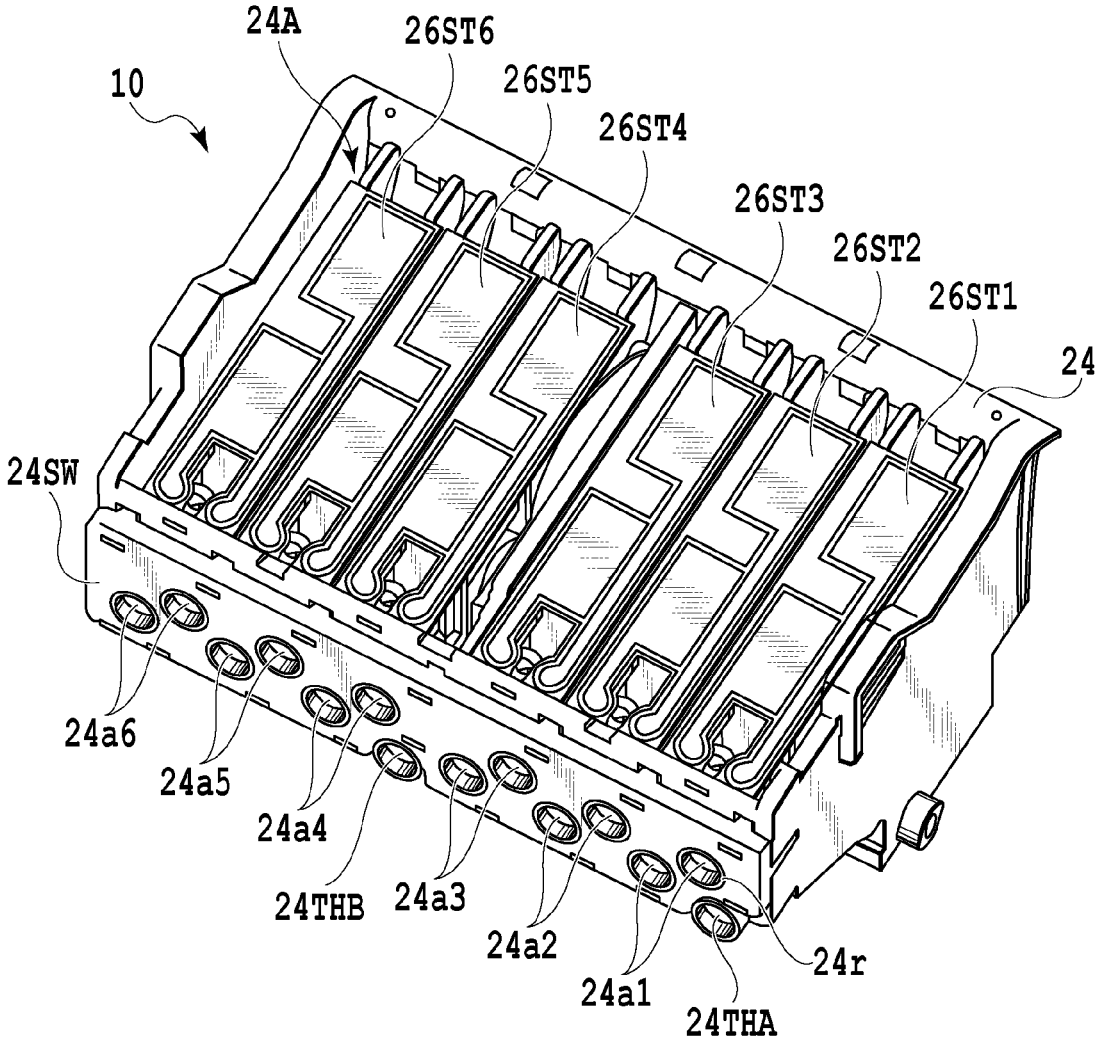
FIG. 5 is a perspective view of the liquid ejecting apparatus shown in FIG. 1.
Figure 6:
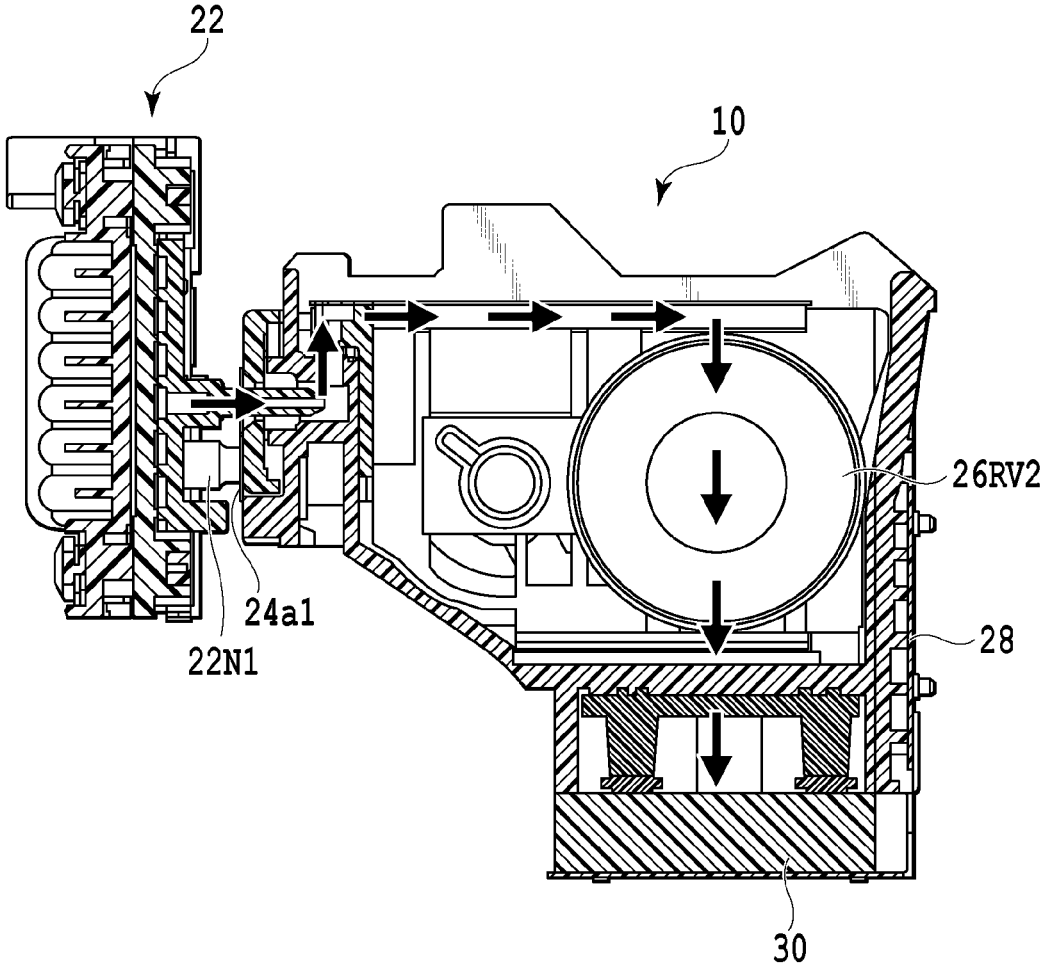
FIG. 6 is a cross sectional view that illustrates a state wherein the liquid ejection apparatus illustrated in FIG. 1 is connected to the tube connecting connector.

Also, as shown in FIG. 6, the tips of the ink supply needles 22N1, 22N2, 22N3, 22N4, 22N5, and 22N6 of each pair are inserted, at approximately the same time, into the aperture pairs 24*a*1, 24*a*2, 24*a*3, 24*a*4, 24*a*5, and 24*a*6 of each pair, which serve as open ends formed on the connection end 24SW of the sub-ink-tank accommodation unit 24. It should be noted that the ink supply needles 22N1 to 22N6 of each pair correspond respectively to the apertures 24*a*1 to 24*a*6 of each pair formed on the connection end 24SW (see FIG. 5).

Herewith a pair of the ink supply needles 22N1 to 22N6 introduce each of the inks through the connection end 24SW and into each of the supply pathways, which communicate into the later described sub-ink tanks 26ST1 to 26ST6.

Explanation will be made with respect to the ink supply needle pairs 22N1, and explanation with respect to the other ink supply needles 22N2 to 22N6 of each pair will be omitted because the ink supply needles 22N1 to 22N6 of each pair have the same configuration as each other.

One ink supply needle among the ink supply needle pairs 22N1 is formed at a position that is offset, in the direction denoted by the X arrow of FIG. 3, with respect to the other ink supply needle. That is, it is offset along the array direction of the ink supply needles 22N1 to 22N6. Thus, a pair of the ink supply needles 22N1 is arranged such that a hypothetically extending straight line that connects the tips of the needles of the ink ejection needle pairs 22N1 would intersect with the direction denoted by the Z arrow of FIG. 3, which is perpendicular to the X arrow.

As shown in FIG. 4, positioning pins 22PA and 22PB are respectively provided near the ink supply needles pairs 22N1 and 22N3 of the tube connecting connector 22. And, as shown in FIG. 5, the positioning pins 22PA and 22PB are respectively inserted into the positioning holes 24THA and 24THB, which are provided on the connection end 24SW of the sub-ink-tank accommodation unit 24.

As shown in FIG. 2, the print head unit 10 is detachably mounted to the print head CA, which is arranged facing with respect to the printing surface of the printing medium PA and is capable of moving reciprocally. The carriage CA is moved by a driving mechanism of the ink jet printer, in the direction that crosses the conveyance direction of the print medium PA, which is intermittently conveyed according to the printing operations of the print head unit 10.

Figure 1:
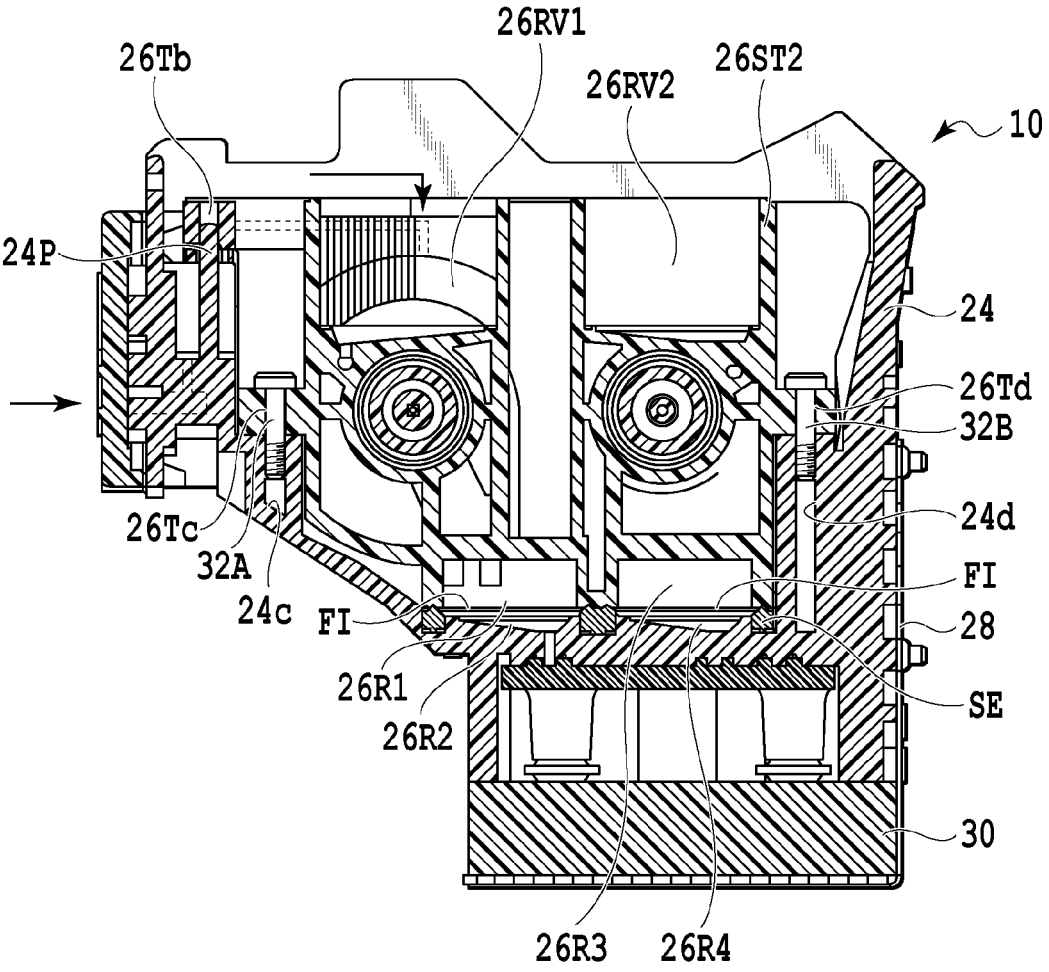
FIG. 1 is a cross sectional view that illustrates a liquid ejection apparatus of the present invention.

The print head unit 10, as shown in FIGS. 1, 3 and 4, is configured to include sub-ink-tanks 26ST1 to 26ST6, and a sub-ink-tank accommodation unit 24 that has a tank accommodation portion 24A at its inner side, as its main components. And, in addition, the print head unit 10 is equipped with an ink ejection unit 30, which is provided on the lower end of the sub-ink-tank accommodation unit 24. As shown in FIGS. 4 and 5, in the tank accommodation portion 24A of the sub-ink-tank accommodation unit 24, the sub-ink-tanks 26ST1, 26ST2, 26ST3, 26ST4, 26ST5, and 26ST6 are arranged parallel to each other. The tank accommodation portion 24A of the sub-ink-tank accommodation unit 24 is formed by facing sidewall portions, a wiring board fixation end that connects both of the sidewall portions, and a connection end 24SW in which the apertures 24*a*1 to 24*a*6 of each pair are formed.

The aperture pairs 24*a*1 to 24*a*6 of the connection end 24SW correspond to the array of ink supply needle pairs 22N1 to 22N6 of the above described tube connecting connector 22, and are formed on a common surface. Thus, because the ink supply needle pairs 22N1 to 22N6 are disposed on a common surface, and the aperture pairs 24*a*1 to 24*a*6 are disposed on a common surface of the connection end 24SW that faces the tube connecting connector 22, a reduction in size of the tube connecting connector 22 is planned.

The respective aperture pairs shown in FIGS. 5, 24*a*1, 24*a*2, 24*a*3, 24*a*4, 24*a*5, and 24*a*6, as shown in FIG. 6, are in communication with the ink supply pathways that are in communication with the internal pathways inside the sub-ink-tanks. And, as shown schematically in FIG. 7, collar shaped sealing members 24*r* are provided at the respective aperture pairs 24*a*1, 24*a*2, 24*a*3, 24*a*4, 24*a*5, and 24*a*6. Ink leakage is herewith avoided because insertion of the ink supply needle pairs 22N1 to 22N6 into the respective apertures 24*a*1 to 24*a*6 is sealed.

A positioning hole 24THA, which fits together with the positioning pin 22PA, is formed below the right aperture (in upper row of apertures as seen in FIG. 5) of the aperture pair 24*a*1. Likewise, a positioning hole 24THB, which fits together with the positioning pin 22PB, is formed below the right aperture (in upper row of apertures as seen in FIG. 5) of the aperture pair 24*a*4.

A wiring board 28, which transmits a drive pulse signal group supplied through the carriage (see FIG. 2) by a print operation control unit (not shown) to the print element substrate of a later described ink ejection unit 30, is provided on the wiring board fixation end (see FIG. 6).

As shown by FIG. 1, ink retention portions 26R2 and 26R4, which separately retain ink of each of the ink colors, is provided at the portion that forms the bottom of the tank accommodation unit 24A. The ink retention portions 26R2 and 26R4 communicate the respective ink discharge paths provided thereon with the ink ejection unit 30 (see FIG. 6).

Sealing members SE are formed at each of the bottom portions of first ink retention chamber 26R1 and a second ink retention chamber 26R3 shown in FIG. 1, and they hermetically seal the ink retention chambers 26R1 and 26R3. Similarly, sealing members, which separately hermetically seal first and second retention chambers of each of the ink retention chambers, are provided on each of the later described sub-ink-tanks 26ST1 to 26ST6.

Explanation will be made with respect to the sub-ink-tank 26ST2, and explanation with respect to the other sub-ink-tanks 26ST1, 26ST3 to 26ST6 will be omitted because the sub-ink-tanks 26ST1 to 26ST6 have the same configuration as each other.

The sub-ink-tank 26ST2 has through-holes 26Tc and 26Td, which are for insertion of screws 32A and 32B, formed as sub-ink-tank-side fixation portions as shown in FIG. 1. The screws 32A and 32B fix the sub-ink-tank 26ST2 and the tank accommodation portion 24A, and hold them at a prescribed location, byway of being screwed into the insertion holes 24*c* and 24*d*, which continue the aforementioned through-holes and are formed on the tank accommodation portion 24A.

Figure 7:
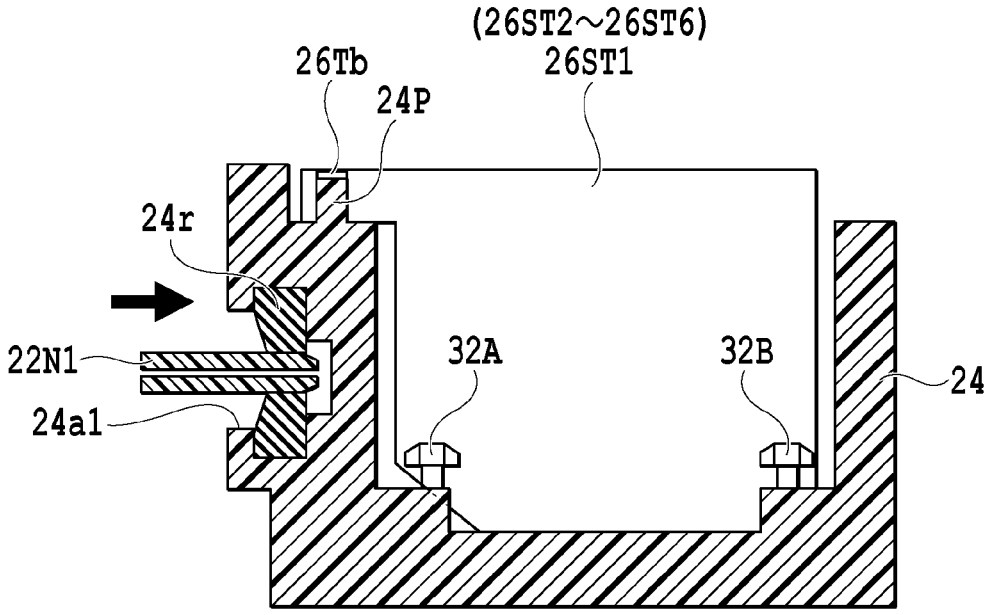
FIG. 7 is a diagram that schematically shows a state where an ink supply needle is connected to the sub-ink-tank accommodation unit of the example shown in FIG. 1.
Figure 8A:
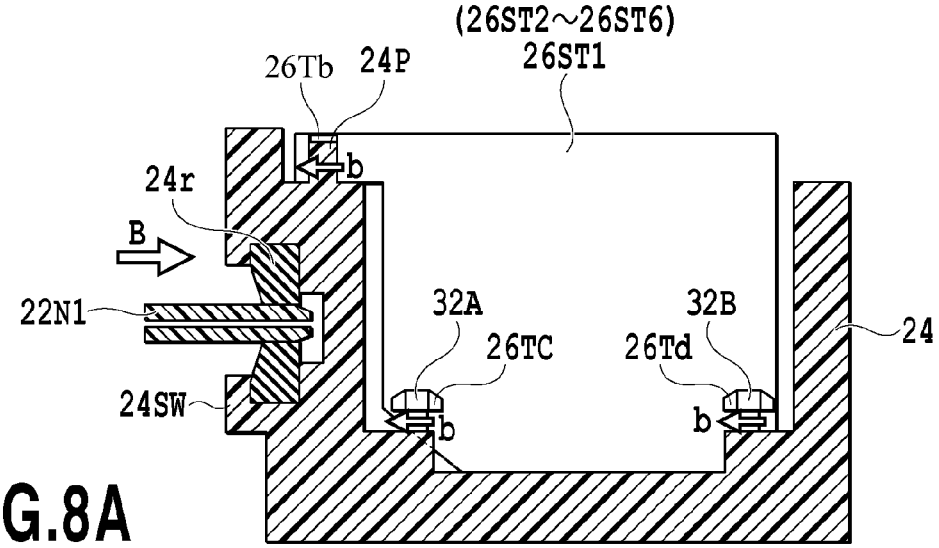
FIG. 8A is a diagram made available for explaining the motion in the case where the ink supply needle is connected to the sub-ink-tank accommodation unit of the example shown in FIG. 1.
Figure 8B:
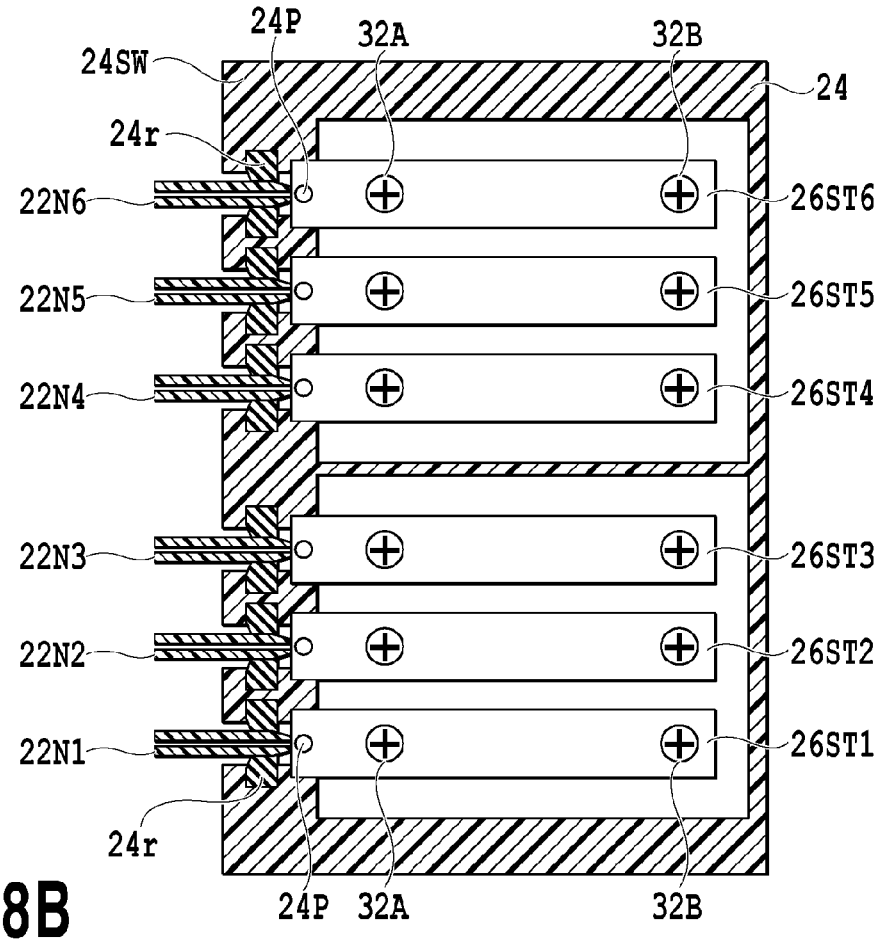
FIG. 8B is a top view of FIG. 8A.

As shown in FIG. 7, taking the fixation portion at which the screw 32A is inserted as the first fixation portion and the fixation portion at which the screw 32B is inserted as the second fixation portion, at the region above the aperture 24*a*1 of the tank accommodation portion 24A, the connection pin 24P, which connects each of the sub-ink-tanks and the tank accommodation portion 24A, is formed as an integrated part of the connection end 24SW forming the tank accommodation portion 24A. And, as shown in FIG. 8A, a fitting hole 26Tb, which is for fitting the aforementioned connection pin 24P, is formed at the sub-ink-tank 26ST2 side as a third fixation portion. Due to the third fixation portion being formed in this manner at the upper end of the sub-ink-tank 26ST2, when inserting the ink supply needle 22N1 along the direction of the arrow B shown in the FIG. 8A, detrusion and deformation of the later described tank accommodation portion 24A, such that it would approach the sub-ink-tank 26ST2, is restrained by way of, at the upper region of the tank accommodation portion 24A and the sub-ink-tank 26ST2 (26ST1) pushed in the direction of arrow B, the connection pin 24P being pushed back in the direction of the arrow b. And, as shown in FIG. 8B, each of the connection pins 24P are formed on a central axis that connects the centers of the screws 32A and 32B, which fix each of the sub-ink-tanks 26ST1 to 26ST6. By way of being aligned in this manner, it is possible to restrain the occurrence of a positional deviation of the sub-ink-tanks, caused by the generation of a rotational moment with respect to the sub-ink-tanks, because a counteracting force works along the central axis that connects the aforementioned screws 32A and 32B, which run along the direction in which the ink supply needle is inserted (the direction of arrow B).

The mechanism by which ink is supplied to the sub-ink-tank 26ST2 and the mechanism by which ink is supplied from the sub-ink-tank 26ST2 will be explained next. Ink is supplied from the aforementioned right aperture (as seen in FIG. 5) of the aperture pair 24*a*2 to the first retention chamber 26R1 shown at FIG. 1, and retained therein. This ink is supplied from an ink discharge pathway (not shown) to the ink ejection unit 30 via a pressure regulation unit 26RV1 that regulates to a prescribed pressure, according to the ink ejection operations of the ink ejection unit 30. The pressure regulation unit 26RV1 is provided at a location that is upstream of the first retention chamber 26R1 of the sub-ink-tank 26ST2. Likewise, ink is supplied from left aperture (as seen in FIG. 5) of the aforementioned lower array side aperture 24*a*2 to the second retention chamber 26R3, and retained therein. And, ink of different colors, to be supplied via pressure regulation units 26V2, are retained at the second retention chamber 26R3.

The inks that have been supplied to the first retention chamber 26R1 and the second retention chamber 26R3 are respectively supplied, through filters FI, from the ink discharge pathways of the aforementioned ink retention portions 26R2 and 26R4 to the ink ejection unit 30. In the ink ejection unit 30, that ink is supplied to common liquid chambers (not shown) that correspond to the print element substrate for each ink color, used for ink ejection.

Generally, the respective colors of ink that are supplied through the apertures 24*a*1 to 24*a*6 are supplied to the ink ejection unit 30 from the ink discharge pathways of the sub-ink-tanks 26ST1 to 26ST6. And, they are supplied to the ink ejection unit 30 along the direction shown by the arrows in FIG. 6, via the pressure regulation units 26RV1 and 26RV2.

With respect to the above structure, a case of assembling the sub-ink-tanks 26ST1 to 26STS to the tank accommodation portion 24A will be explained. First, the positions of each of the third fixation portions (the fitting holes) 26Tb of the sub-ink-tanks 26ST1 to 26ST6 are aligned with the connection pins 24P of the tank accommodation portion 24A. Next, the sub-ink-tanks 26ST1 to 26ST6 are inserted into the tank accommodation portion 24A until the first fixation portion (the through hole) 26Tc and the second fixation portion (the through hole) 26Td respectively touch the tank holder inside the tank accommodation portion 24A.

Next, the screw 32A and the screw 32B are respectively screwed through the first and second fixation portions (the through holes) 26Tc and 26Td into the threaded bores 24*c* and 24*d*.

In the case where, as shown in FIG. 7, the tube connecting connector 22 is connected to the connection end 24SW of the sub-ink-tank accommodation unit 24, the tips of the ink supply needle pairs 22N1 to 22N6 are inserted into the sealing member 24*r* at the same time. Herewith, as shown in FIG. 8A, the insertion force caused by the frictional force between the tips of the ink supply needle pairs 22N1 to 22N6 and the sealing member 24*r*, acts on the tank accommodation portion 24A in the insertion direction.

In doing so, that insertion force is transmitted to the sub-ink-tanks 26ST1 to 26ST6 via the third fixation portion (the fitting hole) 26Tb and the connection pin 24P. Herewith, by way of being fixed by the first and second fixation portions (the through holes) 26Tc and 26Td, and the third fixation portion (the fitting hole) 26Tb, rigidity of the tank accommodation portion 24A is reinforced, the counteracting force, which works against the insertion force of the ink supply needles being inserted into the apertures, works effectively, and it is possible to restrain deformation of the connection end 24SW. Because of such reasons, the connection end 24SW does not locally deform, due to deformation of the tank accommodation portion 24 being restrained, and due to it not being deformed, therefore the tips of the ink supply needles 22N1 to 22N6 are reliably inserted into the apertures and reliably sealed to the sealing member that seals the apertures, and it is possible to suppress the leakage of ink.

Figure 9:
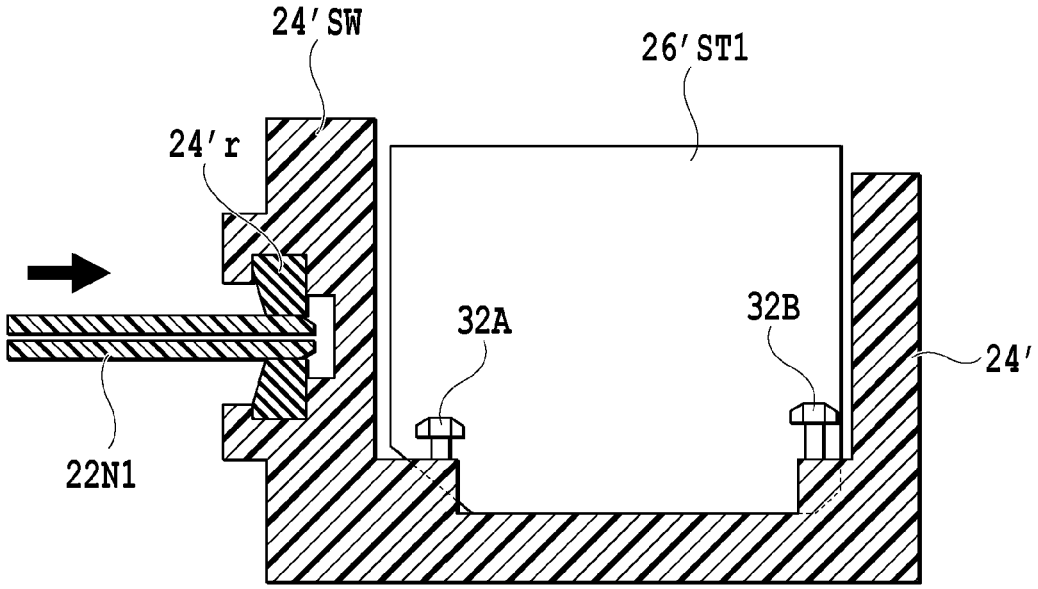
FIG. 9 is a diagram that schematically shows a state where an ink supply needle is connected to the sub-ink-tank accommodation unit of an example for comparison.
Figure 10A:
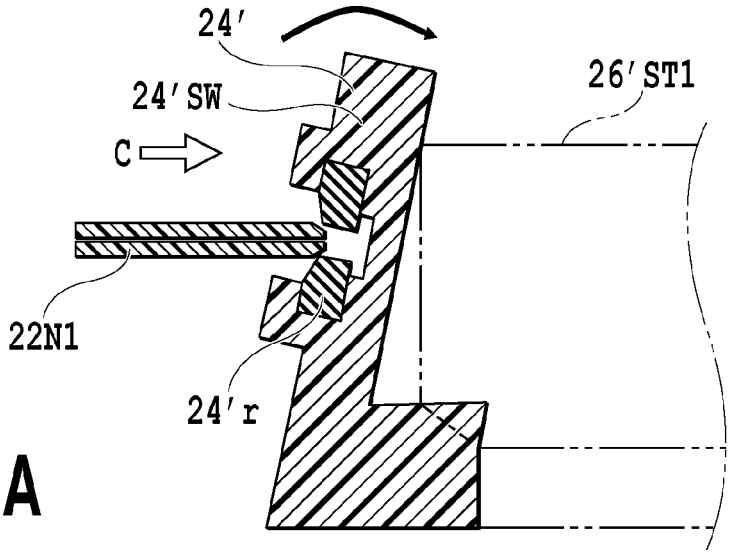
FIG. 10A is a diagram made available for explaining the motion in the case where the ink supply needle is connected to the sub-ink-tank accommodation unit of the example for comparison shown in FIG. 9.
Figure 10B:
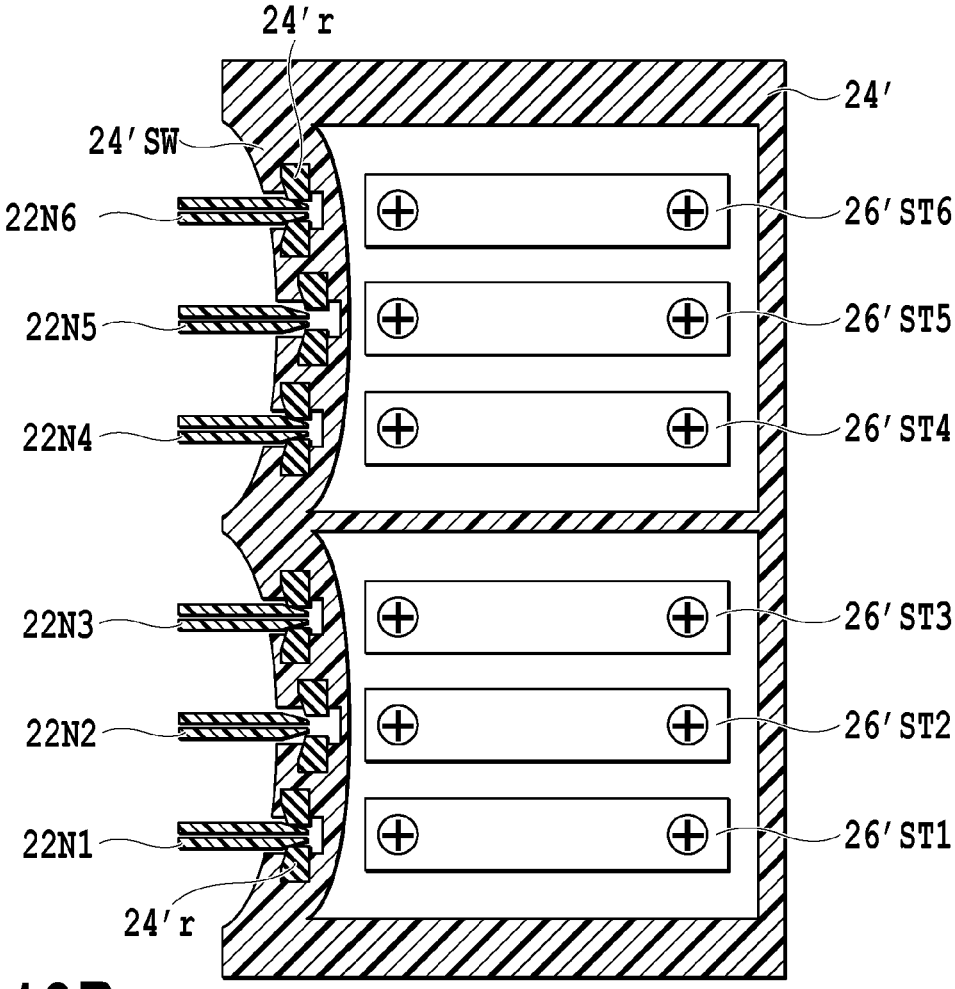
FIG. 10B is a top view of FIG. 10A.

As an example for comparison, as shown in FIG. 9, for example, a case will be hypothetically considered where sub-ink-tanks 26'ST1 to 26'ST6 are fixed to the sub-ink-tank accommodation unit 24' by only the screws 32A and 32B. In such a case there is a concern that, when the tip of the ink supply needle 22N1 as shown in FIG. 10 is inserted inside the seal member 24'*r*, because the tank accommodation portion is pushed in the direction of the arrow C and detrudes toward the sub-ink-tank side, the aperture side of the tank accommodation portion would curve and deform as shown in FIG. 10B.

When a plurality of ink supply needles 22N1 to 22N6 are inserted into the apertures of the tank accommodation portion, which has deformed in the above manner, several of the ink supply needles, among the plurality of ink supply needles, are not reliably inserted into the sealing member 24'*r* and the sealing there becomes inadequate. In such a case, when ink is supplied to the ink supply needles 22N1 to 22N6, there is a possibility that ink leakage will occur from the locations where sealing is inadequate.

According to the above described embodiment of the invention, it is possible to suppress, as described immediately above, ink supply needle insertion not being reliably sealed and the occurrence of ink leakage, caused by the tank accommodation portion 24A being pushed and deforming, by way of the existence of a plurality of fixation portions for fixing a sub-ink tanks 24 and the tank accommodation portion 24A, and there being at least one fixation portion at the region above the apertures into which the ink supply needles are inserted. It should be noted that the area that is described as the "region above" the apertures denotes the entire area of the sub-ink-tank end portion protruded through the tank holder of the tank accommodation portion 24A of a sub-ink-tank.

In the above example, the sub-ink-tanks 26ST1 to 26ST6 are fixed to the sub-ink-tank accommodation unit 24 by way of the screws 32A and 32B being screwed into holes. It should be noted that the fixation member is not limited to the above embodiment; for example, without using screws such as that of the above embodiment at the first and second fixation portions, fixation may be carried out by way of a stud holder and a nut.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2010-192351, filed Aug. 30, 2010 and 2011-180741, filed Aug. 22, 2011 which are hereby incorporated by reference herein in their entirety.

What is claimed is:

1. A liquid ejecting apparatus, comprising:

an ink ejecting portion;

an ink tank that has an ink retention portion that retains ink and supplies the ink ejecting portion with ink;

a tank holder that accommodates the ink tank; and an ink supply needle that has an ink supply aperture formed therein, the ink supply needle being inserted into an insertion portion provided in a sidewall of the ink tank to supply the ink tank with the ink, wherein the tank holder comprises a plurality of fixation portions for fixing the ink tank to the ink tank holder, the plurality of fixation portions including a first fixation portion provided at the sidewall of the tank holder, and a second fixation portion provided at a portion other than the sidewall of the tank holder, and a central axis of the first fixation portion projects in a direction intersecting a direction of inserting the ink supply needle.

2. The liquid ejecting apparatus according to claim 1, wherein the first fixation portion fixes the ink tank and the tank holder by way of a connection pin being formed on at least one of the ink tank and the tank holder, and an insertion hole, which is for insertion of the connection pin, being formed on the other of the ink tank and the tank holder.

3. The liquid ejecting apparatus according to claim 1, wherein a distance between the first fixation portion and a bottom surface of the tank holder is greater than a distance between the insertion portion of the sidewall of the ink tank and the bottom surface of the tank holder.

4. The liquid ejecting apparatus according to claim 1, wherein the second fixation portion is provided on a bottom surface of the tank holder.

5. The liquid ejecting apparatus according to claim 1, wherein the central axis of the first fixation portion projects in a direction substantially perpendicular to the direction of inserting the ink supply needle.

6. The liquid ejecting apparatus according to claim 1, wherein the first fixation portion is formed on an upper surface of the sidewall of the tank holder.

7. The liquid ejecting apparatus according to claim 1, wherein plural second fixation portions are formed for each first fixation portion.

8. The liquid ejecting apparatus according to claim 7, wherein the plurality of second fixation portions and the first fixation portion are formed in a line when viewing the tank holder from above.

9. A tank holder for accommodating an ink tank retaining ink, the tank holder comprising:

a sidewall having an insertion portion which supplies ink to the ink tank through insertion of an ink supply needle that has an ink supply aperture formed therein; and a plurality of fixation portions for fixing the ink tank to the ink tank holder, the plurality of fixation portions including a first fixation portion provided at the sidewall of the tank holder, and a second fixation portion provided at a portion other than the sidewall of the tank holder, and a central axis of the first fixation portion projects in a direction intersecting a direction of inserting the ink supply needle.

10. The tank holder according to claim 9, wherein a distance between the first fixation portion and a bottom surface of the tank holder is greater than a distance between the insertion portion of the sidewall of the ink tank and the bottom surface of the tank holder.

11. The tank holder according to claim 9, wherein the second fixation portion is provided on a bottom surface of the tank holder.

12. The tank holder according to claim 9, wherein the central axis of the first fixation portion projects in a direction substantially perpendicular to the direction of inserting the ink supply needle.

13. The tank holder according to claim 9, wherein the first fixation portion is formed on an upper surface of the sidewall of the tank holder.

14. The tank holder according to claim 9, wherein plural second fixation portions are formed for each first fixation portion.

15. The tank holder according to claim 14, wherein the plurality of second fixation portions and the first fixation portion are formed in a line when viewing the tank holder from above.

* * * * *